US006569498B2

(12) United States Patent
Bibber

(10) Patent No.: US 6,569,498 B2
(45) Date of Patent: May 27, 2003

(54) PASSIFICATION OF ZINC SURFACES

(75) Inventor: John Bibber, Batavia, IL (US)

(73) Assignee: Sanchem, Inc., Chicago, IL (US)

( * ) Notice: Subject to any disclaimer, the term of this patent is extended or adjusted under 35 U.S.C. 154(b) by 0 days.

(21) Appl. No.: 09/909,569

(22) Filed: Jul. 20, 2001

(65) Prior Publication Data

US 2003/0017273 A1 Jan. 23, 2003

(51) Int. Cl.[7] ..... B05D 1/36; B05D 3/10

(52) U.S. Cl. ..... 427/404; 427/327; 427/409; 427/419.1; 427/419.2

(58) Field of Search ..... 427/404, 419.1, 427/409, 419.2, 327

(56) References Cited

U.S. PATENT DOCUMENTS 3,720,547 A * 3/1973 Melotik ..... 148/252
4,631,093 A * 12/1986 Etemovich ..... 148/244
5,820,741 A * 10/1998 Bibber ..... 205/287

FOREIGN PATENT DOCUMENTS

JP 3-20477 A * 1/1991

OTHER PUBLICATIONS

ASTM, Standard Specification for Chromates on Aluminum 1, pp. 1–5, 1998.

AAMA Technical Information Center, Voluntary Specification for High Performance Organic Coatings on Architectural Extrusions and Panels, pp. 1–7, No date provided.

* cited by examiner

*Primary Examiner*—Michael Barr
(74) *Attorney, Agent, or Firm*—Robert F. I Conte; Barnes & Thornburg

(57) ABSTRACT

I provide a method of coating zinc or zinc plated article with a non-hexavalent chromium oxide protective coating by coating a cleaned zinc or zinc plated article with a permanganate composition having a PH of about 2.0 to about 9.0 and I also provide a passified zinc or zinc plated article having coated thereon a permanganate composition that will allow the article to be painted with an appropriate paint

3 Claims, No Drawings

PASSIFICATION OF ZINC SURFACES

FIELD OF INVENTION

This invention relates to a method of coating zinc metal and/or zinc coated articles, such as galvanized steel, with a permanganate composition to provide the zinc with greater paint adhesion and to the zinc articles so coated.

BACKGROUND OF THE INVENTION

Unpassified zinc generally will form a thin film of zinc oxide which will prevent the adhesion of paint. Passification will prevent the growth of zinc oxides ( see British patent No. 592,072; Wendorff Z., Zolnierowicz, A.; Ochronaprzad Korozja, 13, 1 (1970); Ostrander, G. W.: Plating, 38 1033 (1951); and British Patent No. 594,699). Typical passification processes use a dichromate or a chromate composition. The compositions are applied by simple immersion or by electrochemical methods (see Fishlock, D. J.: Product Finishing, 12, 87 ( 1959). A number of different PH's, immersion times and temperatures may be used. The use of a chromate or dichromate passification will generally increase the corrosion resistance. Corrosion resistance is generally tested by a salt—spray ("ASTM—B117" testing specification) see: Stareck, J. E., Cybulskis, W. S.: Proc. Am. Electroplaters Soc. 34, 235 (1947). The hexavalent chromium present in the chromate and/or dichromate compositions is extremely toxic, and as such, is being banned from use in many European countries and many areas of the United States.

My patent U.S. Pat. No. 5,8200,741 provides for the passification of zinc using a trivalent chromium composition. My present invention provides for the passification of zinc with a chromium-free permanganate composition. The chromium coated zinc and/or zinc coated articles must generally be painted prior to the chromium completely setting. If it is not, the paint will not adequately adhere to the chromium surface.

SUMMARY OF INVENTION

The present invention concerns a method for coating zinc and/or zinc coated articles, i.e. zinc plated steel, with a non—hexavalent chromium permanganate coating composition having a PH of about 2.0 to 9.0.

The invention also concerns a passified zinc or zinc coated article having coated thereon a manganese oxide protective coating produced by an alkali metal permanganate solution. The alkali metal is selected from potassium, sodium or lithium. The preferred alkali metal being potassium. The concentration of permanganate necessary to produce an acceptable coating being a minimum of 0.001 moles per liter. With potassium permanganate this corresponds to about 0.16 grams per liter. The maximum concentration of the permanganate is the saturation point of the salt being used. The solution may have a temperature ranging from above the freezing point of the solution to its boiling point. The preferred temperature range being 60° F. to 180° F. As the temperature of the solution rises, less immersion time is required to form a corrosion resistant coating on the surface of the zinc. The immersion time for preparing a corrosion resistant coating on a zinc surface is about 45 seconds to 3 minutes at 60° F. Preferred immersion time is 45–90 seconds. A longer immersion time then the predetermined optimum time will not increase the performance level of the coating to any great extent.

Other compounds may be added to the composition, such as PH buffers, to adjust the PH of the composition. The compounds used should not have an adverse effect upon the corrosion resistant or paint adhesion properties of the coating.

A PH below 2 and above 9 would have a deleterious affect on the zinc.

A desirable protective coating is one which will allow the zinc surface to be painted and pass the dry paint adhesion according AAMA coating specification: 605.2-85, which is incorporated herein and submitted with this application.

The following examples illustrate the invention in detail, and are not intended to limit the scope of the invention. In the examples, the zinc surface of a zinc plated steel or a pure zinc sheet was cleaned of oils and loose dirt with a non—ionic detergent. The non-ionic cleaned zinc surface was further cleaned by being made the cathode of an electrolytic cell of 12 volts and 10 amps for 30 seconds in a dilute sodium carbonate solution (2.5 grams per liter) to obtain a chemically clean and receptive surface. The surface was then washed with one percent nitric acid to remove all alkali residue and rinsed with D. I. water. This cleaned pure zinc sheet and/or zinc plated steel sheet was passified immediately. The zinc sheet and/or zinc plated sheet used in the examples were metal strips three inch by five inch and 1/16 inch thick. The zinc plated steel sheet had a zinc coating thickness of 0.0002 inches.

When subjected to a five percent neutral salt—spray (PH=6.5 to 7.2) according to "ASTM Standard B—117" untreated, but cleaned as specified above, pure zinc and zinc plated steel will show signs of corrosion, as evidenced by a white film of zinc oxides and hydroxides. Zinc plated steel will show signs of corrosion after one-half to one hour of exposure. Pure zinc will show signs of corrosion after one to two hours of exposure.

In all of the examples below, unless otherwise indicated, one panel was treated in order to test for paint adhesion after being allowed to dry by sitting in the open air for 24 hours. This panel was painted with a flat black enamel from "Rust—Oleum" Corp., Product No. 7776, allowed to dry for seven days and tested for dry paint adhesion according to "AAMA" coatings specification: 605.2-85.

Example 2 is given to show that a chromate based coating will not give acceptable paint adhesion when allowed to age for 24 hours. Examples 5, 8, 10, 15, 17, and 19 illustrate the paint adhesion failure of the permanganate based coating when used outside established PH and concentration limits.

EXAMPLE 1

A solution of 3.0 grams per liter of Potassium Permanganate at a PH of 7.0 and a temperature of 70° F. was used to immediately treat at separate times a pair of 3×5 inch pure zinc metal panels (each cleaned as outlined above). Each of the panels were exposed to the potassium permanganate solution for 60 seconds. Each of the panels was removed, rinsed in D.I. water, and dried in the open air for 24 hours. One panel was painted and passed the "AAMA—605.2-85" dry paint adhesion test. The other panel was exposed to a 5% neutral salt spray according to "ASTM" specification; "B—117". After 27 hours of exposure the panel began to show a white film of corrosion products.

EXAMPLE 2

A standard dichromate composition used to passivate zinc (Biestek, T.:"Prace Instytutu Mechaniki Precyzyjnei", 19,39

(1966)) consisting of 200 grams per liter of sodium dichromate and 6 ml/liter of concentrated sulfuric acid was used to immediately coat at separate times a pair of 3×5 inch pure zinc metal panels, each cleaned as outlined above. Each of the panels was exposed to the sodium dichromate solution for 10 seconds at 70° F., rinsed in D. I. water, and allowed to dry for 8 hours at room temperature. One panel was painted and did not pass the "AAMA—605.2-85" dry paint adhesion test. The other panel was exposed to a 5% neutral salt spray according to "ASTM" specification; "B—117". After 100 hours of exposure, this panel began to show a white film of corrosion products.

EXAMPLE 3

A solution of 3.0 grams per liter of Potassium Permanganate at a PH of 7.0 and a temperature of 35° F. was used to immediately treat, at separate times, a pair of 3×5 inch pure zinc metal panels, each cleaned as outlined above. Each of the panels was exposed to the potassium permanganate solution for 180 seconds at 35° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 27 hours of exposure, this panel began to show a white film of corrosion products.

EXAMPLE 4

A solution of 3.0 grams per liter of Potassium Permanganate at a PH of 7.0 and a temperature of 170° F. was used to immediately treat, at separate times, a pair of 3×5 inch pure zinc metal panels, each cleaned as outlined above. Each of the panels was exposed to the potassium permanganate solution for 60 seconds at 170° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 27 hours of exposure this panel began to show a white film of corrosion products.

EXAMPLE 5

A solution of 3.0 grams per liter of Potassium Permanganate at a PH of 1.5 and a temperature of 70° F. was used to immediately treat, at separate times, a pair of 3×5 inch pure zinc metal panels, each cleaned as outlined above. Each of the panels was exposed to the potassium permanganate solution for 60 seconds at 70° F. The panels were removed from the solution, rinsed in D. I. water, and allowed to dry. One panel was painted and did not pass the "AAMA—605.2-85" dry-paint adhesion test. The other panel was exposed to a 5% neutral salt spray according to "ASTM" specification; "B—117". After 8 hours of exposure this panel began to show a white film of corrosion products.

EXAMPLE 6

A solution of 3.0 grams per liter of Potassium Permanganate at a PH of 2.0 and a temperature of 70° F. was used to immediately treat, at separate times, a pair of 3×5 inch pure zinc metal panels, each cleaned as outlined above. Each of the panels was exposed to the potassium permanganate solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 16 hours of exposure, this panel began to show a white film of corrosion products.

EXAMPLE 7

A solution of 3.0 grams per liter of Potassium Permanganate at a PH of 9.0 and a temperature of 70° F. was used to immediately treat, at separate times, a pair of 3×5 inch pure zinc metal panels, each cleaned as outlined above. Each of the panels was exposed to the solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 14 hours of exposure, this panel began to show a white film of corrosion products.

EXAMPLE 8

A solution of 3.0 grams per liter of Potassium Permanganate at a PH of 9.5 and a temperature of 70° F. was used to immediately treat at separate times a pair of 3×5 inch pure zinc metal panels, each cleaned as outlined above. Each of the panels was exposed to the potassium permanganate solution for 60 seconds at 70° F. The panels were removed from the solution, rinsed in D. I. water, and allowed to dry. One panel was painted and did not pass the "AAMA—605.2-85" dry paint adhesion test. The other panel was exposed to a 5% neutral salt spray according to "ASTM" specification; "B—117". After 7 hours of exposure, this panel began to show a white film of corrosion products.

EXAMPLE 9

A solution of 0.16 grams per liter of Potassium Permanganate at a PH of 7.0 and a temperature of 70° F. was used to immediately treat, at separate times, a pair of 3×5 inch pure zinc metal panels, each cleaned as outlined above. Each of the panels was exposed to the solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 17 hours of exposure, this panel began to show a white film of corrosion products.

EXAMPLE 10

A solution of 0.10 grams per liter of Potassium Permanganate at a PH of 7.0 and a temperature of 70° F. was used to immediately treat, at separate times, a pair of 3×5 inch pure zinc metal panels, each cleaned as outlined above. Each of the panels was exposed to the solution for 60 seconds at 70° F. The panels were removed from the solution, rinsed in D. I. water, and allowed to dry. One panel was painted and did not pass the "AAMA—605.2-85" dry paint adhesion test. The other panel was exposed to a 5% neutral salt spray according to "ASTM" specification; "B—117". After 6 hours of exposure, this panel began to show a white film of corrosion products.

EXAMPLE 11

A saturated solution of Potassium Permanganate at a PH of 7.0 and a temperature of 70° F. was used to immediately treat, at separate times, a pair of 3×5 inch pure zinc metal panels, each cleaned as outlined above. Each of the panels was exposed to the potassium permanganate solution for 180 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 28 hours of exposure, this panel began to show a white film of corrosion products.

EXAMPLE 12

A solution of 3.0 grams per liter of Potassium Permanganate at a PH of 4.0 and a temperature of 70° F. was used to immediately treat, at separate times, a pair of 3×5 inch pure zinc metal panels, each cleaned as outlined above. Each of the panels was exposed to the potassium permanganate solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 29 hours of exposure, this panel began to show a white film of corrosion products.

EXAMPLE 13

A solution of 3.0 grams per liter of Potassium Permanganate at a PH of 7.0 and a temperature of 70° F. was used to immediately treat, at separate times, a pair of 3×5 inch zinc plated steel panels, each cleaned as outlined above. Each of the panels was exposed to the solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 20 hours of exposure, this panel began to show a white film of corrosion products.

EXAMPLE 14

A solution of 0.16 grams per liter of Potassium Permanganate at a PH of 7.0 and a temperature of 70° F. was used to immediately treat, at separate times, a pair of 3×5 inch zinc plated steel panels, each cleaned as outlined above. Each of the panels was exposed to the potassium permanganate solution for 200 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 8 hours of exposure, this panel began to show a white film of corrosion products.

EXAMPLE 15

A solution of 0.10 grams per liter of Potassium Permanganate at a PH of 7.0 and a temperature of 70° F. was used to immediately treat, at separate times, a pair of 3×5 inch zinc plated steel panels, each cleaned as outlined above. Each of the panels was exposed to the potassium permanganate solution for 60 seconds at 70° F. The panels were removed from the solution, rinsed in D. I. water, and allowed to dry. One panel was painted and did not pass the "AAMA—605.2-85" dry paint adhesion test. The other panel was exposed to a 5% neutral salt spray according to "ASTM" specification; "B—117". After 1.5 hours of exposure, this panel began to show a white film of corrosion products.

EXAMPLE 16

A solution of 3.0 grams per liter of Potassium Permanganate at a PH of 2.0 and a temperature of 70° F. was used to immediately treat, at separate times, a pair of 3×5 inch zinc plated steel panels, each cleaned as outlined above. Each of the panels was exposed to the potassium permanganate solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 4.0 hours of exposure, this panel began to show a white film of corrosion products.

EXAMPLE 17

A solution of 3.0 grams per liter of Potassium Permanganate at a PH of 1.5 and a temperature of 70° F. was used to immediately treat, at separate times, a pair of 3×5 inch zinc plated steel panels, each cleaned as outlined above. Each of the panels was exposed to the potassium permanganate solution for 60 seconds at 70° F. The panels were removed from the solution, rinsed in D. I. water, and allowed to dry. One panel was painted and did not pass the "AAMA—605.2-85" dry paint adhesion test. The other panel was exposed to a 5% neutral salt spray according to "ASTM" specification; "B—117". After 4.0 hours of exposure, this panel began to show a white film of corrosion products.

EXAMPLE 18

A solution of 3.0 grams per liter of Potassium Permanganate at a PH of 9.0 and a temperature of 70° F. was used to immediately treat, at separate times, a pair of 3×5 inch zinc plated steel panels, each cleaned as outlined above. Each of the panels was exposed to the potassium permanganate solution for 60 seconds at 70° F. The panels were removed from the solution, rinsed in D. I. water, and allowed to dry. One panel was painted and passed the "AAMA—605.2-85" dry paint adhesion test. The other panel was exposed to a 5% neutral salt spray according to "ASTM" specification; "B—117". After 4.0 hours of exposure, this panel began to show a white film of corrosion products.

EXAMPLE 19

A solution of 3.0 grams per liter of Potassium Permanganate at a PH of 9.5 and a temperature of 70° F. was used to immediately treat, at separate times, a pair of 3×5 inch pure zinc metal panels, each cleaned as outlined above. Each of the panels was exposed to the potassium permanganate solution for 60 seconds at 70° F. The panels were removed from the solution, rinsed in D. I. water, and allowed to dry. One panel was painted and did not pass the "AAMA—605.2-85" dry paint adhesion test. The other panel was exposed to a 5% neutral salt spray according to "ASTM" specification; "B—117". After 1.0 hours of exposure, this panel began to show a white film of corrosion products.

While this invention has been illustrated and described in the proceeding disclosure, it is recognized that variations and changes may be made, therein, without departing from the invention as set forth in the claims.

What is claimed is:

1. A method for coating zinc or zinc plated article with a manganese oxide protective coating that is free of chromium comprising coating a cleaned zinc or zinc plated article with a permanganate composition having a PH of about 2.0 to about 9.0 and a permanganate concentration of at least 0.001 moles per liter wherein the permanganate is an alkali metal permanganate with the alkali metal being selected from the group consisting of sodium, potassium, and lithium;

maintaining a temperature of the permanganate composition at between 35° F. to 180° F.;

exposing the cleaned zinc or zinc plated article to the permanganate composition for at least 45 seconds; and drying the permanganate coated zinc or zinc plated article wherein the permanganate zinc or zinc plated article can be painted and provide an anti-corrosion paint protected zinc or zinc plated article that will pass the AAMA—605.2-85 dry paint adhesion test.

2. The method of claim 1, comprising the further step of painting the dried permanganate zinc or zinc plated article to provide the paint protected zinc or zinc plated article that will pass the AAMA—605.2-85 dry paint adhesion test.

3. The method of claim 2, wherein the zinc or zinc plated article is first cleaned; with a non-ionic detergent and then cleaned with a sodium carbonate solution to provide said cleaned zinc or zinc plated article.

* * * * *